United States Patent [19]

Olsen et al.

[11] Patent Number: 4,740,032

[45] Date of Patent: Apr. 26, 1988

[54] COMPACT AND LIGHTWEIGHT BENCH WITH REMOVABLE PARTS

[76] Inventors: Phyllis Olsen; Stanley Olsen, both of 75 Silla La., Arizona City, Ariz. 85223

[21] Appl. No.: 912,319

[22] Filed: Sep. 29, 1986

Related U.S. Application Data

[63] Continuation-in-part of Ser. No. 757,663, Jul. 22, 1985, abandoned.

[51] Int. Cl.[4] ..... A47B 3/06

[52] U.S. Cl. ..... 297/157; 108/111; 297/442

[58] Field of Search ..... 297/157, 159, 442; 108/101, 111; 248/188.9

[56] References Cited

U.S. PATENT DOCUMENTS

| | | | |
|---|---|---|---|
| 2,006,502 | 7/1935 | Hallowell | 248/188.9 |
| 2,628,668 | 2/1953 | Basile | 108/159 |
| 2,903,222 | 9/1959 | Levi | 248/169 |
| 3,300,245 | 1/1967 | Rumble | 297/442 X |
| 4,076,305 | 2/1978 | Sullivan | 108/99 X |
| 4,084,517 | 4/1978 | Guess | 297/442 X |

*Primary Examiner*—Kenneth J. Dorner
*Assistant Examiner*—Peter R. Brown
*Attorney, Agent, or Firm*—Wegner & Bretschneider

[57] ABSTRACT

An improved bench table embodying at least five distinguishable removable parts and suitable for rapid, compact and lightweight assembling and disassembling is disclosed. A table top and at least two bench seats have smooth upper surfaces and wholly non-apertured. The improved bench table makes use of lightweight, but sturdy material to ensure convenient and effective transportation when not in use and ready for storage. By providing preferable plurality of ribbing means incorporated thereto in the various removable parts of said bench table, said parts are capable of withstanding concentrated stresses exerted thereto when in use. Also a strap member is provided for passing therethrough slot portions of the upper portion of the leg members to permit transport of the removable parts when stacked and stored away. The bottom portions of the leg members are provided with integral extending members therefrom for insertion into slot portions of opposingly located leg members for locking thereto when the removable parts are stacked and stored thereto.

5 Claims, 4 Drawing Sheets

COMPACT AND LIGHTWEIGHT BENCH WITH REMOVABLE PARTS

This is a continuation-in-part of application Ser. No. 757,663, filed July 22, 1985, now abandoned.

BACKGROUND OF THE INVENTION

1. Field of the Invention

This invention generally relates to an improved compact and lightweight picnic or patio bench table having removable parts suitable for being securely assembled when in use and compact and easy to handle when ready to be transported and stored. The improved compact bench table of the present invention has at least five integral parts to maximize compactness, easy to assemble and simultaneous rigidity. In order to permit stability from outside natural elements, such as wind, the improved compact bench table is provided with a plurality of aperture means in a table top support passing therethrough. Additionally, a plurality of ribbings therethroughout each removable part may be integrally incorporated as a part thereof to permit structural strength for accommodating concentrated stresses exerted thereto.

2. Description of the Relevant Art

In order to provide a table that may be easily transported to and from a desired area; such as, a camp ground, public park, or a mere house or apartment patio, it is essential to provide a picnic table that incorporates therein compact and lightweight removable parts and suitable for easy and rapid assembling or disassembling. Such a table may be necessitated by perhaps the tendency for public parks to be overcrowded, especially during the summer months, and thus decreasing the chances of availability of public park picnic benches. Moreover, a patio bench table that does not utilize removable parts tend not to be stored indoors by a homeowner or apartment landlord and is thereby left continuously outdoors to fend the variegated extreme elements of the weather which causes rapid deterioration of said bench table.

In order to provide a bench table to alleviate the abovementioned problems, it is known in the related art to provide a removable combination bench and table set as disclosed in U.S. Pat. No. 3,189,379 filed on Dec. 23, 1963 and issued on June 15, 1965 to H. W. Potter; a picnic table having multiple removable parts in U.S. Pat. No. 3,300,245 filed on Jan. 21, 1966 and issued on Jan. 24, 1967 to F. J. Rumble; circular table and seat construction having slotted pieces for attaching therewith in U.S. Pat. No. 3,758,152 filed on Oct. 21, 1971 and issued on Sept. 11, 1973 to Gary F. Lake; and a knock-down mobile picnic table and bench assembly having apertures passing through bench seats and a table top to permit accommodation of protruding members originating from part members in U.S. Pat. No. 4,076,305 filed on Mar. 29, 1977 and issued on Feb. 28, 1978 to D. Sullivan.

In the patent issued to H. W. Potter, however, a plurality of a combination of hinges and bolts are used to attach a multiple of parts to an integrated bench top and seat supports thereby considerably decreasing the time and increasing the inconvenience for assembling or disassembling of the various bulky parts. In the Rumble and Sullivan patents, slotted portions pass through the table top, as well as the bench seats to permit protruding members originating from the table top support and bench seat supports to be accommodated therein, respectively. The significant disadvantages in both the Rumble and Sullivan patents include the tendencies of said protruding members to be severed and, if not properly manufactured to desired specifications, will extend beyond the top surfaces of the table top and bench seats which precludes the efficient use of the above-mentioned parts, especially if precious seating or table top spaces are essential to fully take advantage of the benefits desired of the table and bench assembly. In the patent by Lake, a circular table and continuous seat construction are fabricated from a single sheet of rectangular material to permit the assembling of a plurality of parts including distinguishable support members for spacing and joining thereto the circular table top and continuous circular table seat. The structure of Lake's table and seat construction precludes rapid disassembling and compact joining of the plurality of parts for storage and transportation when not in use.

A need was therefore felt to provide an improved compact and lightweight bench table having removable parts for easy and rapid assembling and disassembling for full effective utility of all its parts.

It is therefore an object of the present invention to provide an improved compact and lightweight bench table having removable parts which can be rapidly assembled absent any extensive parts which are not integral parts of said invention when fully assembled.

It is another object of the present invention to provide an improved compact and lightweight bench table having removable parts which makes use of all its parts at a maximum and thereby providing optimum efficiency in its use.

It is still another object of the present invention to provide an improved compact and lightweight bench table having removable parts suitable for rapid disassembly and compact accommodation with each other to allow easy transportation and effective storage.

It is a further object of the present invention to provide an improved compact and lightweight bench table which can accommodate a minimum number of removable parts, preferably at least five distinguishing parts, to allow effective and rapid assembling and disassembling of said parts to form a sturdy bench table for use in a picnic or outdoors in a patio.

It is still a further object of the present invention to provide an improved compact and lightweight bench table which may have a plurality of ribbing means which may be incorporated into the plurality of removable parts to permit accommodation therefrom of exerted stresses thereto.

It is still a further object of the present invention to provide an improved compact and lightweight bench table which can be easily and economically produced, yet sturdy in construction and highly efficient in operation.

It is still a further object of the present invention to provide an improved compact and lightweight bench table which is constructed with extreme simplicity, embodying single removable parts, and therefore capable of being retailed for a low price, long-lasting in use, and convenient to handle.

SUMMARY OF THE INVENTION

The aforementioned and other objects of the present invention are accomplished by providing an improved bench table embodying at least five distinguishable removable parts and suitable for rapid, compact and lightweight assembling and disassembling. The improved bench table makes use of lightweight, but sturdy material to ensure convenient and effective transportation when not in use and ready for storage. By providing preferable plurality of ribbing means incorporated thereto in the various removable parts of said bench table, said parts are capable of withstanding concentrated stresses exerted thereto when in use.

These and other features of the invention will be understood upon reading of the following description along with the drawings.

DESCRIPTION OF THE PREFERRED EMBODIMENT

Figure 1:
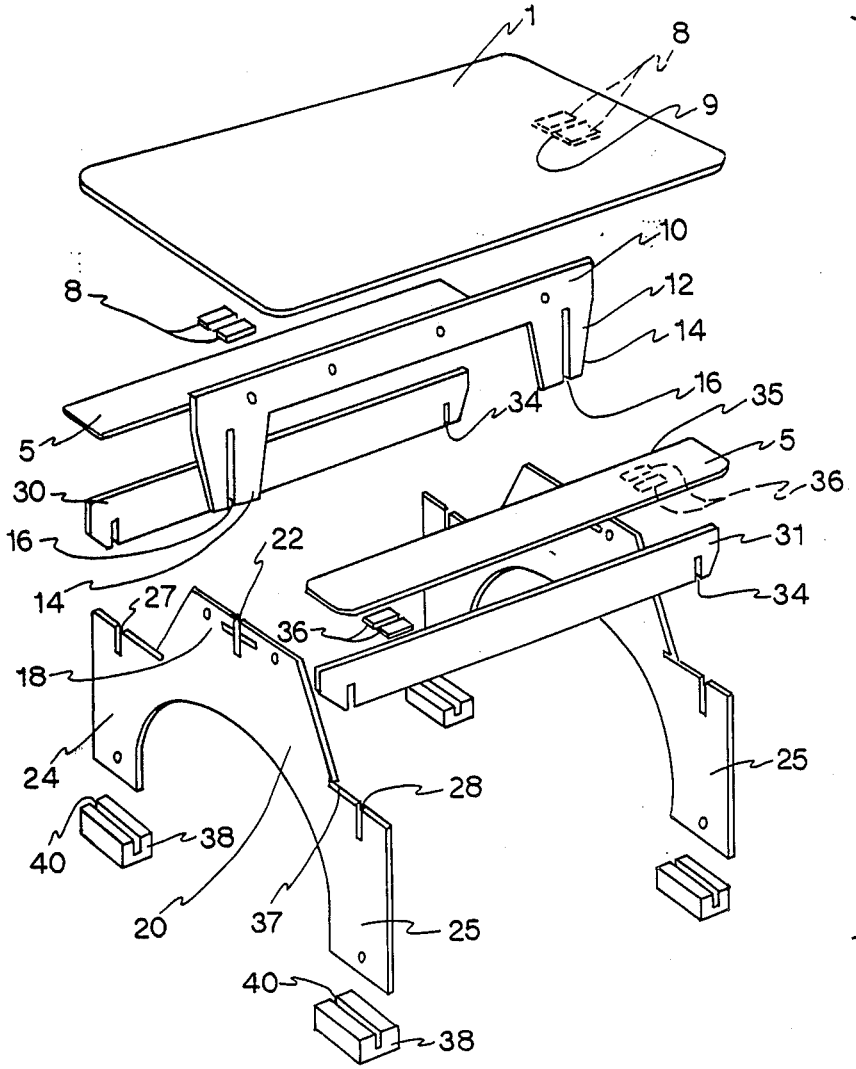
FIG. 1 is a perspective exploded view of an improved compact and portable table and bench combination in accordance with the present invention showing wholly a non-apertured table top and bench seats.
Figure 5F:
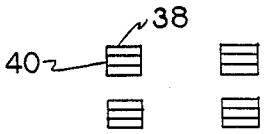
FIG. 5*f* is an elevational view illustrating the top surface of each of at least four bench feet of the present invention with two associated elongated slots therein for mounting.

FIG. 1 is a perspective exploded view of an improved compact and lightweight bench table showing a plurality of removable parts, including a wholly non-apertured table top 1 and bench seat 5. Below the table top 1 are at least two pairs of preferably rectangular mounting members 8, proximately located in parallel from each other, preferably integrally attached thereto for accommodating in a space 9 therebetween an upper portion 10 of a table top support 12. The table top support 12 has at least two vertically downward protruding members 14 opposed at each end of said table top support 12. Each vertically downward protruding member 14 has a slot 16 passing therethrough terminating from a bottom end to proximate said upper portion of said table top support 12. Each slot 16 allows communication with an upper part 18 of a table leg 20 having on said upper part 18 a vertically partially extending slit 22 to the upper portion 10 of the table top support 12 passing therebetween slot 16.

In order to allow a stable lower support for the bench table top 1, the lower portion of each table leg 20 has a semicircular configuration therebelow expanding to both leg side members 24, 25. Each leg side member 24, 25 has on its upper end a vertical slot 27, 28, respectively for accommodating a seat support 30, 31 for passing through slots 34 therebetween. The upper portion of each seat support 30, 31 permits the accommodation thereto of a bench seat 5 which is mounted thereon between at least a pair of proximately located parallel mounting members 36. At least two pairs of mounting members 36 are preferably integrally joined at the bottom surface of the bench seat 5 preferably at a distance apart from each other; each pair of said mounting members 36 preferably located proximate each opposing longitudinal end at the bottom surface of each bench seat 5. In order to provide further stability, i.e., to preclude any wobble effect when the bench seat 5 is used, the inner side 35 of said bench seat is positioned and accommodated therein into at least two gap openings 35 of the table leg 24 thereabove each of leg side member 24, 25.

Each bottom portion of each leg side member 24, 25 has a preferably integral foot block member 38 preferably having a length equivalent to the width of the side member 24, 25 and a width preferably at a dimension to permit compact storage when stored integral to said table leg 20. Each foot block member 38 has a slot portion 40 cut longitudinally along the upper portion of each block member to permit accommodation therein a bottom portion of a a leg side member 24, 25.

Figure 2:
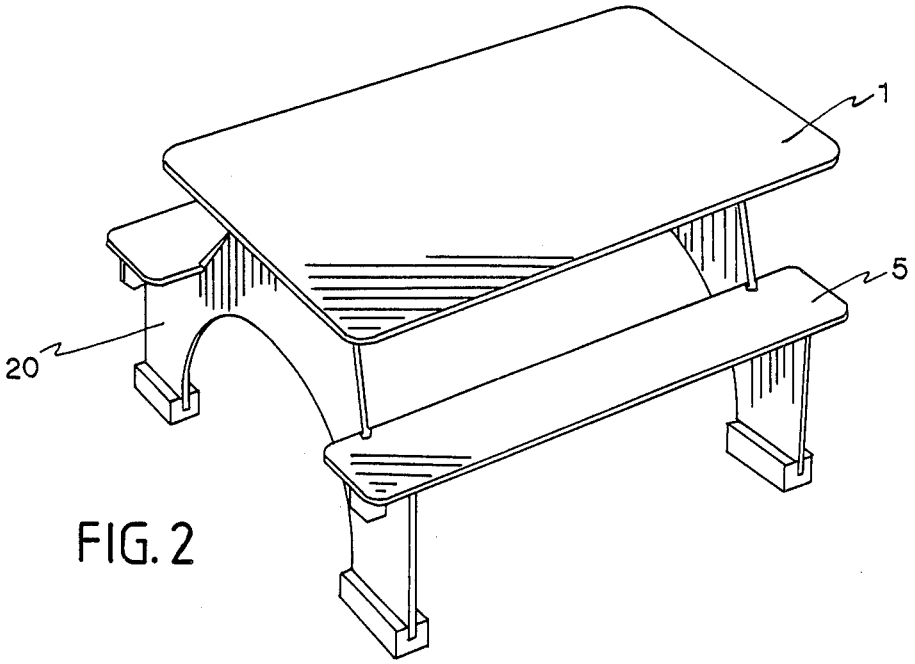
FIG. 2 is a perspective view of the improved compact and portable table and bench combination of the present invention fully assembled and ready for use.

In order to assemble each of the above-mentioned parts of the bench table to a complete operational and ready to use embodiment, as shown in FIG. 2, each part is preferably made of a lightweight, yet sturdy, long-lasting and convenient to handle material. Each of the above-mentioned part is preferably made of NORYL FN-215 thermoplastic foam resin having a 5 to 10% glass fiber composition to provide highly suitable mechanical properties essential for thin-walled structural parts as embodied in the above-identified parts; thereby reducing the plurality of ribbing means to accommodate the various stresses exerted thereto. Further, said thermoplastic foam resin exhibits highly desirable low creep and water absorption rate, as well as tensile, impact strengths and flexural modulus and highly suitable for formation of fillets and radii to reduce the load at points of stress concentration. Thus, what is accomplished is a lightweight bench table when fully assembled as shown in FIG. 2, yet sturdy in construction, highly efficient in operation and easily and economically produced. As illustrated in FIG. 2, the improved compact and portable table and bench combination of the present invention having a wholly non-apertured or smooth upper surface table top 1 and bench seats 5 removably, yet sturdily joined to at least two table legs 20. Additionally, a plurality of stress ribbings (not shown) are incorporated at predetermined locations on each of the above-mentioned removable parts for reinforcing the strength and to accommodate thereto loads which may occur at predetermined points of concentrated stresses when the bench table is in use.

Figure 3:
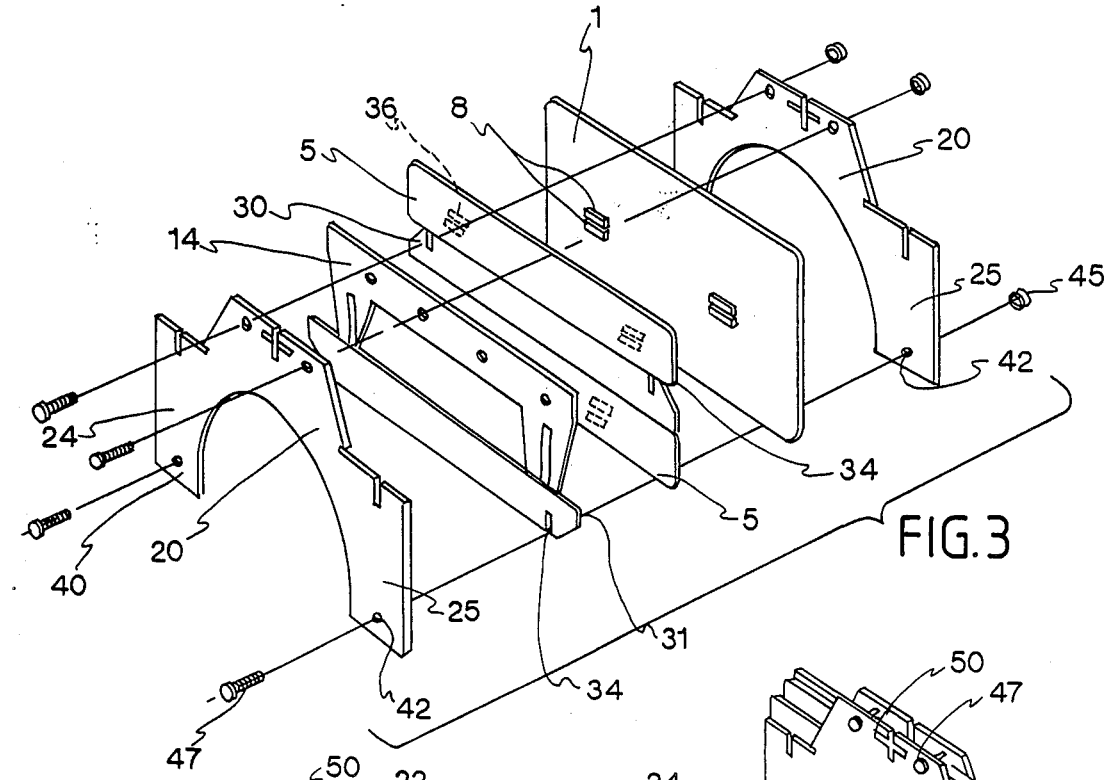
FIG. 3 is a perspective exploded view of the improved compact and portable table and bench combination of the present invention fully disassembled from its ready-to-use structure, as shown in FIG. 2, to a stacked formation ready to be transported and stored.
Figure 5A:
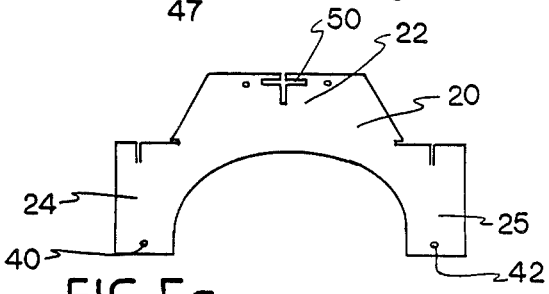
FIG. 5*a* is an elevational view of each of at least a pair of legs of the present invention showing a plurality of apertures and slots therethrough.

In FIG. 3, a perspective exploded view of the improved compact and portable table and bench combination is illustrated to show a manner in which the table can be fully disassembled from its ready-to-use structure, as shown in FIG. 2, to a stacked formation ready to be transported and stored. As illustrated in FIG. 3, one of the table legs 20 initially provides an end portion of said stacked formation which is preferably laid down on the ground to be placed thereon the variegated removable parts of said table. Adjacent to said laid down table leg 20 to be stacked thereon is the table top 1 preferably having the upper surface of said table top 1 abutting the table leg 20 and preferably having the rectangular mounting member 8 opposingly extending away from the table leg 20. Abutting said table top are two bench seats 5 and a seat support 30 theretbetween; the mounting members 36 of said bench seats 5 are preferably adjacent the table top 1 and the slots 34 of said seat support 30 are preferably positioned as the upper portion therein when the seat support 30 is stacked along with the bench seats 5. Abutting the bench seats 5 and the seat support 30 are the table top support 14 preferably stacked above another seat support 31 wherein the slots 34 of the seat support 31 are positioned at the lower portion of the seat support 31 when stacked. Another table leg 20 is thereafter stacked adjacent the table top support 20 to act thereto as an opposing end portion of the fully stacked formation, as shown in FIG. 3, ready for transporting and storing.

Figure 4:
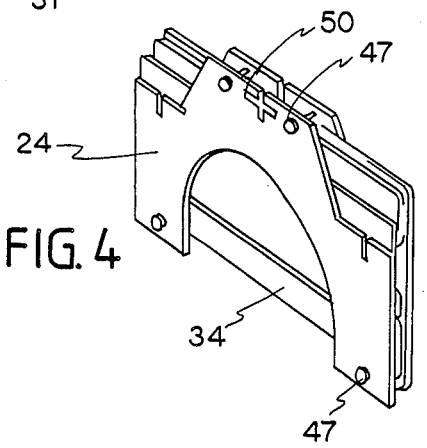
FIG. 4 is a perspective view of the improved compact and portable table and bench combination of the present invention which illustrates the easy to handle and compactness structure when ready to be transported and stored.
Figure 5B:
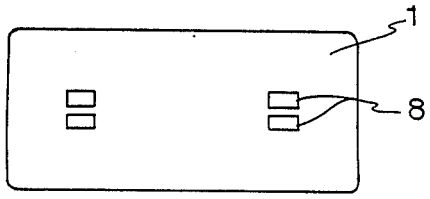
FIG. 5*b* is an elevational view of the table top of the present invention illustrating the associated plurality of paired rectangular mounting members integrally attached at the bottom surface thereto.
Figure 5D:
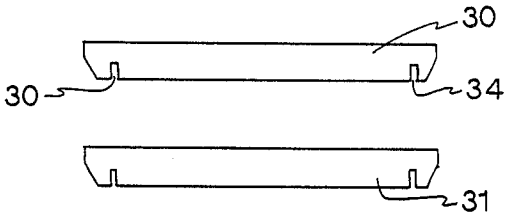
FIG. 5*d* is an elevational view of each of at least a pair of seat supports of the present invention illustrating a plurality of slots therethrough for mounting.
Figure 5C:
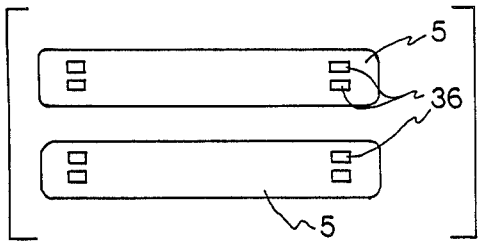
FIG. 5*c* is an elevational view illustrating the bottom surface of each of at least a pair of bench seats of the present invention with the associated plurality of paired mounting members integrally attached thereto.
Figure 5E:
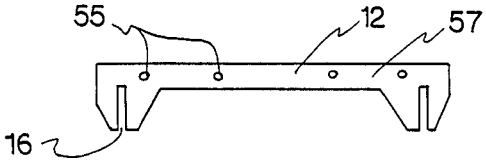
FIG. 5*e* is a side elevational view of a table top support of the present invention illustrating a plurality of slots for mounting and apertures passing therethrough.

To permit the opposing end portions of the stacked formation embodied by the two table legs 20, as previously described, each leg side member 24, 25 has at least an aperture 40, 42 passing therethrough, respectively to permit a nut 42 and bolt 47 combination or a snap-on device combination (not shown) to be accommodated therein for securely forming the ready-for-storage configuration, as shown in FIG. 4, of the compact and portable table and bench combination.

Upon completion of the stacked formation shown in FIG. 4, transporting becomes convenient by providing a horizontal slit 50 on the upper portion of each table leg 24 having a width suitable for accommodating therein at least four average human fingers, except the thumb, to allow manual carrying of the completely stacked formation therefrom.

FIGS. 5*a* to 5*f* are elevational views of the various above-mentioned parts for further clarifying, by means of illustration, the specific features of each of the above-mentioned parts. It is to be further noted that in FIG. 5*e*, the table top support 12 has a plurality of apertures 55 passing therethrough an upper extension member 57 to provide a means for stabilizing the fully assembled compact and portable table and bench combination when used outdoors to fend, or more specifically to allow any crosswinds to pass therethrough thereby significantly increasing a more secure assemblage provided therefrom by the table top support 12.

Figure 6:
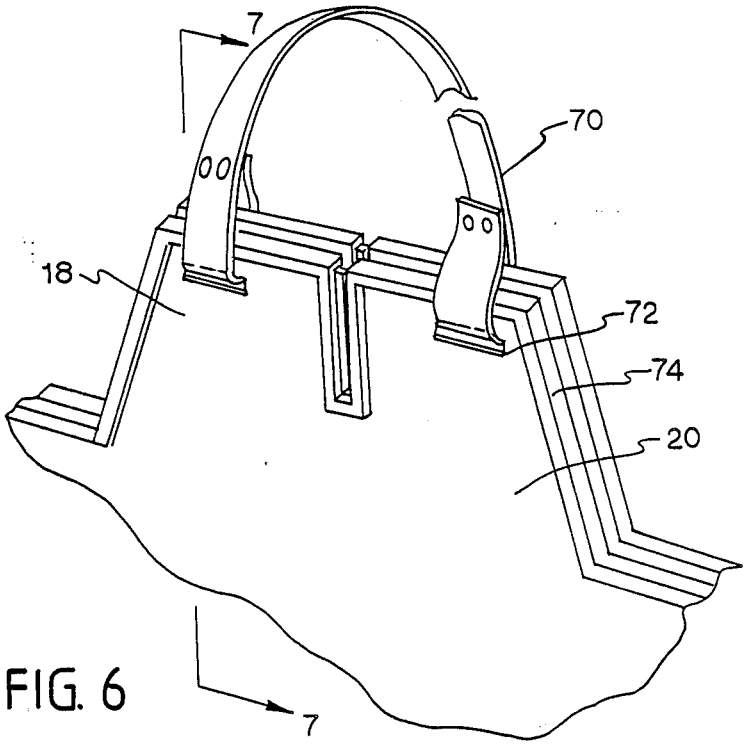
FIG. 6 is a perspective view of the top portion of the leg members of a preferable embodiment of the present invention with an associated strap member fastened thereto for locking the removable parts therein for transport and storage thereof.
Figure 7:
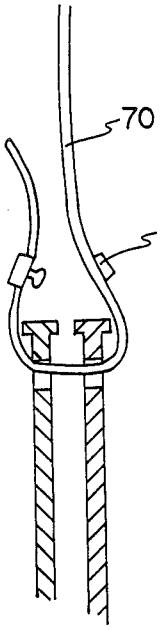
FIG. 7 is a partial cross-sectional view taken along line 7—7 of FIG. 6 showing the manner in which the strap member is accommodated therethrough the top portions of the leg members of the present invention.

In FIG. 6, a strap member 70 is shown passing therethrough slots 72 of the upper parts 18 of the table legs 20 of a preferable embodiment of the present invention. Here, the slots 72 are preferably located proximate the edges 74 of the table leg 20 in order to optimize the locking efficiency of said strap members 70 when in use. In FIG. 7, the strap member 70 has preferably a snap-on type fastening members 76, preferably near the top edges of the table legs 20 for full locking efficiency thereof. The strap member 70 is preferably long to allow it to be mounted on the shoulders of a user.

Figure 8:
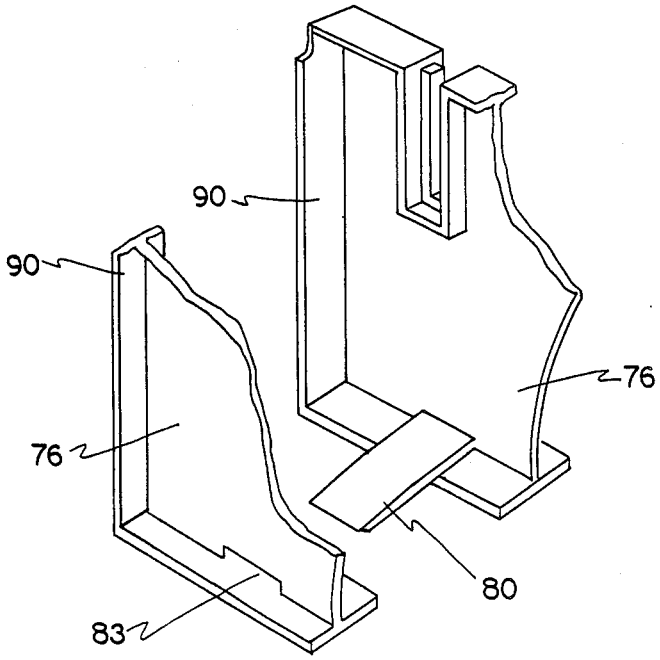
FIG. 8 is a perspective view of the bottom portions of the leg members illustrating a protruding member of a leg member ready for insertion into a slot portion of another opposingly located leg member.
Figure 9:
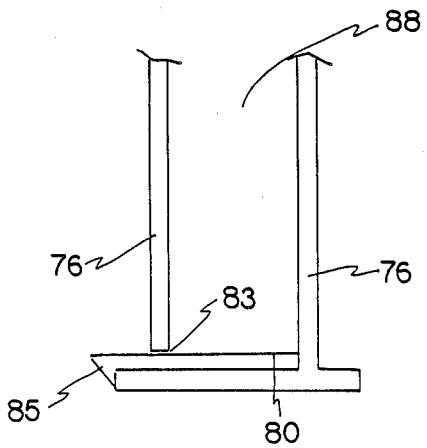
FIG. 9 is a side elevational view of the bottom portions of the leg members when in the locked position.

In FIGS. 8 and 9, the bottom portions 76 of the table legs 20 of the preferred embodiment of the present invention has an extending member 80 integral thereto, as shown, while an opposing bottom portion of another opposingly located leg 20 has a slot portion 83 for accommodating therein said extension member 80. Each leg 30 has at least one extending member 80 and at least one oppositely located slot portion 83. In FIG. 9, the end of the extending member 80 has a downwardly protruding member 85 for locking the bottom portions 76 of the legs 20 together. The space 88 therebetween the legs 20 provides a place for the removable parts (not shown) of the preferred embodiment of the present invention when transported and stored. Further, as illustrated in both FIGS. 8 and 9, the legs 20 of the preferred embodiment of the present invention have a side support member 90 extending substantially perpendicular from therethroughout the edges of the legs 20.

Figure 10:
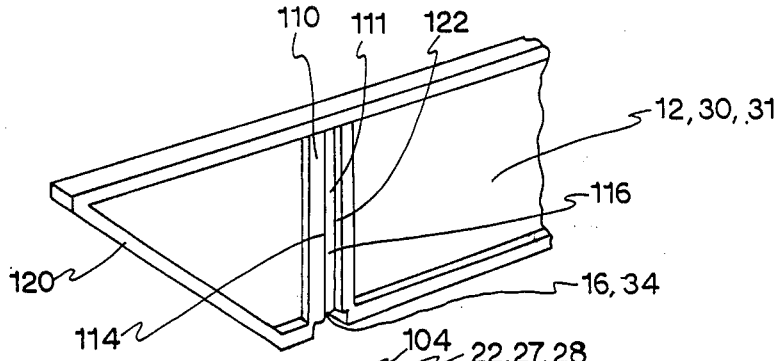
FIG. 10 is a perspective view of slotted portions of the table top and seat support suitable for mating with the leg side members also having a slotted portion therethrough.

As shown in FIG. 10, the table leg 20, table top support 12 and each seat support 30 have slots 16, 34, respectively. The slot 22 of the table leg 20 has opposing sides 101, 102, each having a protruding member 104, 105 extending therefrom. Further, as shown in FIG. 10, it is preferred that the table leg 20 has an extended ribbing member 108 therealong its entire edge, as well as an extended ribbing member 110 therealong the opposing sides 101, 102 of the slot 22.

Moreover, the slots 27, 28 of the table legs 20 are preferably constructed in a similar manner as above-described for the slot 22.

Further, as illustrated in FIG. 10, the slot 16 of the table top support 12 also have opposing sides 110, 111, each having protruding members 114, 116 extending therefrom. Further, it is preferred that the table top support 12 has an extended ribbing member 120 therealong its entire edge, as well as an extended ribbing member 122 therealong the opposing sides 110, 111 of the slot 16.

Also, the slots 34 of the seat supports 30, 31 are preferably constructed in a similar manner, as above-described for the slot 16.

Figure 11:
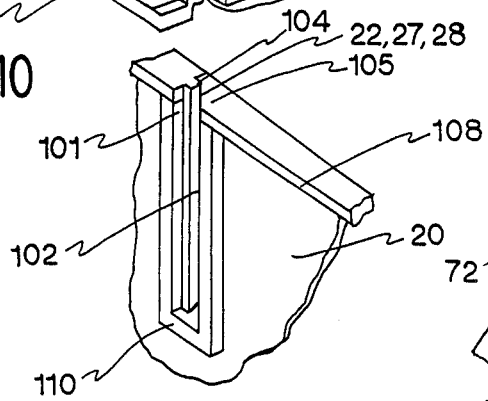
FIG. 11 is a perspective view of the top portion of the leg members of another preferable embodiment of the present invention with the associated strap member passing therethrough a slotted portion of the leg members while having each integral protruding member of each leg member touching each other when the bench table of the present invention is assembled ready for storage.
Figure 11:
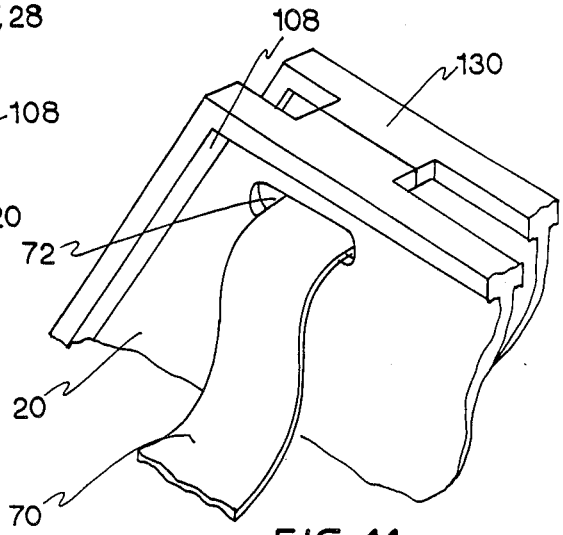

In FIG. 11, thereabove each slot 72 of each table leg 20 is an integral protruding member 130 extending from the extended ribbing member 108. Each protruding member 130 of each table leg 20 touch each other when the table legs 20 are assembled in storage form.

Figure 12:
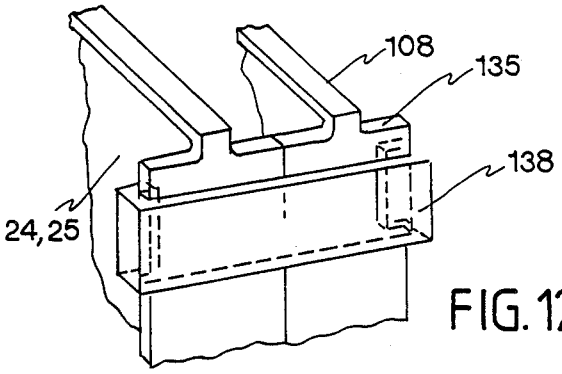
FIG. 12 is a perspective view of at least one clamping member suitable for being slidably braced onto the side and bottom portions of the leg members when the bench table of the present invention is assembled ready for storage.

When assembled for storage, a clamp member 138, generally C-shaped, is slidably positioned, preferably on the side and bottom portions of the table legs 20. The side and bottom portions of the table legs 20 also have, therealong, integral extended ribbing members 135, preferably longer than extended ribbing member 108. As shown in FIG. 12, the clamp member 138 is braced therearound the integral extended ribbing members 135.

Figure 13:
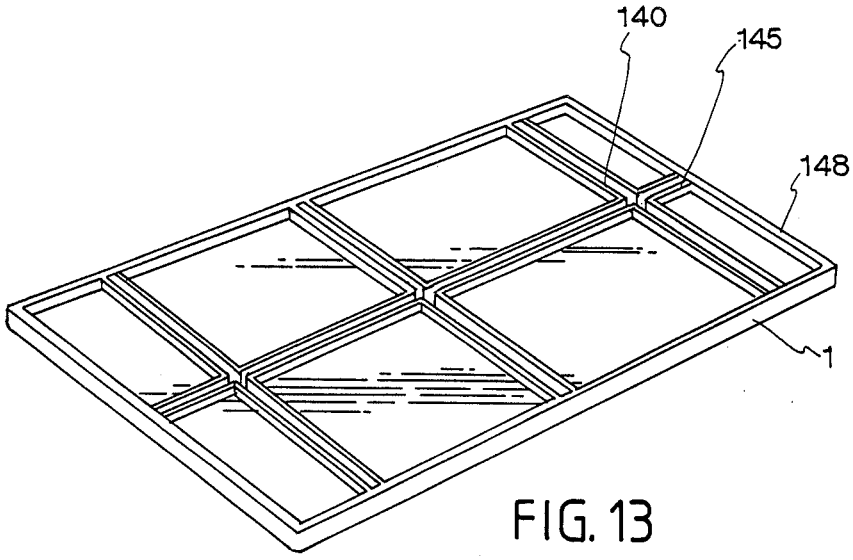
FIG. 13 is a perspective view of integral ribbing members therebelow the table top provided for strength and stability.

In FIG. 13, therebelow the table top 1 are integral ribbing members 140, preferably U-shaped and preferably in a formation shown in FIG. 13. The integral ribbing members 140 has a central ribbing 145, as a part thereof, which accommodates therein the upper portion 10 of the table top support 12. Therealong the edges of the table top 1, is also an integral protruding member 148 for providing additional support and stability thereof when in use or when in storage.

The above description is included to illustrate the operation of the preferred embodiments and is not meant to limit the scope of the invention. The scope of the invention is to be limited only by the following claims. From the above description, many variations are apparent to one skilled in the art which would yet be encompassed by the spirit and scope of the invention.

We claim:

1. A compact and lightweight bench table having removable parts, comprising:

a table top member having a smooth upper surface, said table top member has a lower surface having integrally attached thereto at least a pair of rectangular mounting members, extending substantially along said table top member for forming a slot portion;

a table top support member having two opposing downwardly extending members, each downwardly extending member has a vertical groove passing therealong, the upper portion of said table top support member is suitable for interlocking therebetween said slot portion formed by said pairs of rectangular mounting members of said table top;

at least a pair of leg members, each having at least two opposing side members having an upper end vertical slot passing through the upper portion of each said side member, each of said leg members is suitable for being interlocked into said vertical groove of each downwardly extending member of said table top support member;

at least a pair of seat support members having a support groove passing along each opposing ends of said support member for interlocking a side member of each of said leg members;

at least a pair of bench seat members having smooth upper surfaces, each of said pair of bench seat members has a lower surface having integrally attached thereto at least two pairs of mounting members extending substantially along said seat member for forming a slot portion for interlocking the upper portion of said seat support member; and side support member means extending integrally and substantially perpendicular from therethroughout the edges of said leg members for stabilizing the leg member when in use and for substantially enclosing a fully stacked formation of the bench table when in transport or when in storage.

2. The compact and lightweight bench table as in claim 1 wherein said bench table is made of a material selected from a group consisting of thermoplastic foam resin, hard plastic and fiberglass.

3. The compact and lightweight bench table as in claim 1 wherein said bench table has a plurality of integral ribbing means for accommodating exerted loads at predetermined points of concentrated stresses when said bench table is in use and for interlocking said table top member and said pair of bench seat members.

4. A method of assembling a plurality of removable parts to provide a stack formation for a compact and lightweight bench table when in transport or when in storage, comprising the steps of:

enclosing first and second leg members of said bench table, said first and second leg members have side support means extending integrally and substantially perpendicular from therethroughout the edges of said leg members;

sliding a table top within said first and second leg members, the top portion of said table top having a totally smooth surface directly abutting said first leg member;

sliding at least two bench seats within said first and second leg members abutting said table top;

sliding first and second seat supports and a table top support within said first and second leg members adjacent to said abutting bench seats; and thereafter sliding at least one clamp member over said side support means of said first and second leg members in order to lock said leg members together.

5. A compact and lightweight bench table having removable parts, comprising:

a table top member having a smooth upper surface, wherein said table top member has a lower surface having integrally attached thereto at least a pair of generally rectangular mounting members extending substantially along said table top member for forming a slot portion;

a table top support member having two opposing downwardly extending members, wherein each downwardly extending member has a vertical groove passing therealong, wherein the upper portion of said table top support member is suitable for interlocking therebetween said slot portion formed by said pairs of rectangular mounting members of said table top;

at least a pair of leg members, wherein each having at least two opposing side members having an upper end vertical slot passing through the upper portion of each said side member, wherein each of said leg members is suitable for being interlocked into said vertical groove of each downwardly extending member of said table top support member;

at least a pair of seat support members having a support groove passing along each opposing ends of said support member for interlocking a side member of each of said leg members;

at least a pair of bench seat members having smooth upper surfaces, wherein each of said pair of bench seat members has a lower surface having integrally attached thereto at least two pairs of mounting members extending substantially along said seat member for forming a slot portion for interlocking the upper portion of said seat support member;

side support member means extending integrally and substantially perpendicular from therethroughout the edges of said leg members for stabilizing the leg member when in use and for substantially enclosing a fully stacked formation of the bench table when in transport or when in storage;

at least one member protruding from the bottom portion of one side of one of said legs for insertion into a slotted portion of the bottom portion of an opposite side of another of said legs, wherein another side of said another leg has another member protruding therefrom for insertion into a slotted portion of the bottom portion of an opposite side of one of said legs;

at least one clamp member means for sliding over said side support means of said first and second leg members in order to lock said leg members together; and a strap member suitable for being removably fastened therethrough horizontal slots of said top portion of said leg members.

* * * * *